US010954934B2

(12) United States Patent
Khaldi

(10) Patent No.: US 10,954,934 B2
(45) Date of Patent: Mar. 23, 2021

(54) PUMPING INSTALLATION COMPRISING A PNEUMATIC PUMP AND A VALVE FOR REGULATING SUPPLY OF THE PUMP WITH COMPRESSED GAS

(71) Applicant: EXEL INDUSTRIES, Epernay (FR)

(72) Inventor: Boussif Khaldi, Arnouville (FR)

(73) Assignee: EXEL INDUSTRIES, Épernay (FR)

( * ) Notice: Subject to any disclaimer, the term of this patent is extended or adjusted under 35 U.S.C. 154(b) by 103 days.

(21) Appl. No.: 16/194,524

(22) Filed: Nov. 19, 2018

(65) Prior Publication Data

US 2019/0154028 A1 May 23, 2019

(30) Foreign Application Priority Data

Nov. 20, 2017 (FR) ..... 1760919

(51) Int. Cl.
*F04B 49/03* (2006.01)
*F04B 49/06* (2006.01)
(Continued)

(52) U.S. Cl.
CPC ..... *F04B 49/03* (2013.01); *B05B 7/2491* (2013.01); *F04B 9/12* (2013.01); *F04B 41/02* (2013.01);
(Continued)

(58) Field of Classification Search
CPC ..... F04B 49/03; F04B 49/10; F04B 41/02; F04B 49/06; F04B 49/22; F04B 2201/06;
(Continued)

(56) References Cited

U.S. PATENT DOCUMENTS 4,934,598 A * 6/1990 Schnetzer ..... G05D 11/035 239/67
5,174,722 A 12/1992 Lybecker
(Continued)

FOREIGN PATENT DOCUMENTS

FR 1124528 A 10/1956

OTHER PUBLICATIONS

French Patent Application No. 1760919, INPI Rapport de Recherche Préliminaire, Jun. 29, 2018, 2 pp.
(Continued)

*Primary Examiner* — Philip E Stimpert
(74) *Attorney, Agent, or Firm* — Soquel Group LLC

(57) ABSTRACT

The pumping installation (16) comprises a pneumatic pump (22) for pumping a fluid (12) and a system (24) for supplying the pneumatic pump (22) with compressed gas. The supply system (24) comprises a source (34) of compressed gas and a fluidic connection (36) that fluidly connects the source (34) to the pneumatic pump (22). The pumping installation (16) also comprises a system (38) for controlling the supply of the compressed gas to the pneumatic pump (22), wherein the control system (38) comprises a valve (40) mounted on the fluidic connection (36) and switchable between a blocking state, in which the valve (40) prevents the flow of compressed gas between the source (34) and the pneumatic pump (22), and a passing state, in which the valve (40) allows the circulation of compressed gas between the source (34) and the pneumatic pump (22).

11 Claims, 2 Drawing Sheets

(51) Int. Cl.

| | |
|---|---|
| ***F04B 49/10*** | (2006.01) |
| ***F04B 49/22*** | (2006.01) |
| ***F04B 9/12*** | (2006.01) |
| ***B05B 7/24*** | (2006.01) |
| ***F04B 41/02*** | (2006.01) |

(52) U.S. Cl.
CPC ..... *F04B 49/06* (2013.01); *F04B 49/10* (2013.01); *F04B 49/103* (2013.01); *F04B 49/22* (2013.01); *F04B 2201/06* (2013.01); *F04B 2205/09* (2013.01); *F05B 2270/301* (2013.01)

(58) Field of Classification Search
CPC ..... F04B 2201/063; F04B 2205/09; F04B 9/12–9/137; B05B 7/2491; Y10T 137/7761; G05D 16/20
See application file for complete search history.

(56) References Cited

U.S. PATENT DOCUMENTS

2012/0315163 A1* 12/2012 Yan ..... F04B 9/12 417/375
2016/0377074 A1* 12/2016 Strong ..... F04B 49/065 222/59

OTHER PUBLICATIONS

French Patent Application No. 1760919, INPI Opinion Écrite sur la Brevetabilité de L'Invention, Nov. 20, 2017, 5 pp.

* cited by examiner

PUMPING INSTALLATION COMPRISING A PNEUMATIC PUMP AND A VALVE FOR REGULATING SUPPLY OF THE PUMP WITH COMPRESSED GAS

CROSS-REFERENCE TO RELATED APPLICATION

This application claims priority of French Patent Application No. 17 60919, filed on Nov. 20, 2017.

FIELD OF THE INVENTION

The present invention relates to a pumping installation of the type comprising a pneumatic pump for pumping a fluid and a system for supplying the pneumatic pump with compressed gas, wherein the supply system comprises a source of compressed gas and a fluidic connection that fluidly connects the source to the pneumatic pump.

The installation also relates to a device for spraying a coating product onto a surface to be coated, of the type comprising an applicator for spraying the coating product onto the surface to be coated and a pumping installation for pumping the coating product, and supplying the coating product to the applicator.

BACKGROUND OF THE INVENTION

In known coating product spraying installations, for example spray painting, the applicators that typically consist of spray guns, are generally supplied with coating product under pressure by a pumping installation. This pumping installation usually comprises pneumatic pumps set up in a dedicated room of the building, commonly called "paint kitchen", wherein each pump pumps a coating product into a clean can.

These pumps are fed with a compressed gas, generally air, which is used to drive the pumps with a movement enabling the suction of the coating product into the can and the delivery of the coating product through a fluidic connection that connects the pump to one of the applicators of the installation. The force provided by the compressed gas is arranged to compensate for pressure losses due to the circulation of the coating product in the pump ducts and the delivery of this coating product towards the applicator at the desired pressure.

A problem arises, however, when the coating product reservoir is empty. In fact, at this stage, the pump is no longer able to suck coating product it is dried up and, as the force provided by the compressed gas no longer meets the resistance of the coating product, the pump races, which risks damaging its components. This risk is all the greater as the pumps are isolated in a specific room, and there is no operator nearby to quickly react to the runaway of one of the pumps.

To solve this problem, pumps have been proposed wherein they are equipped with anti-runaway devices, consisting of membranes that lock in the event of strong demand for pressurized gas, thus blocking the arrival of gas under pressure. However, these anti-runaway devices are unreliable.

Anti-runaway devices independent of the pumps have also been proposed, wherein they are designed to cut off the compressed gas supply to the pumps through a complex pneumatic logic in the event of runaway of the pump. These anti-runaway devices are, however, very expensive.

SUMMARY OF THE INVENTION

An object of the invention is thus to provide an economical and reliable solution capable of limiting the risks of runaway of a coating product pump. Another object of the invention is to allow the retrofitting of existing installations with the proposed solution.

For this purpose, the object of the invention is a pumping installation of the aforementioned type, in which the pumping installation also comprises a system for controlling the supply of the pneumatic pump with compressed gas, wherein the control system comprises a valve that is mounted on the fluidic connection and may be switched between a blocking state, in which the valve prevents the flow of compressed gas between the source and the pneumatic pump, and a passing state, in which the valve allows compressed gas circulation between the source and the pneumatic pump.

According to particular embodiments of the invention, the installation also has one or more of the following characteristics, taken in isolation or according to any technically feasible combination:

- the control system comprises an automatic valve control system, wherein the automatic control system comprises a sensor for monitoring a parameter, and an actuator acting on the valve to automatically switch the valve from its passing state to its blocked state as a function of a signal produced by the sensor and representative of the monitored parameter,
- the monitored parameter is represents a state of the pneumatic pump,
- the sensor is capable of generating a predetermined electrical signal when it detects at least one predetermined state of the pneumatic pump, while the actuator is electrically connected to the sensor in order to receive this electrical signal when it is generated, wherein the actuator is further designed to switch the valve from its passing state to its blocked state when it receives this electrical signal,
- the predetermined state comprises a runaway state of the pneumatic pump,
- the valve comprises a body internally defining a passage for the compressed gas, wherein a valve is mounted to move relative to the body between a closed position, in which it closes the passage, and an open position, in which it releases the passage, and a valve restoring member moves it towards its closed position, while the actuator is able to hold the valve in its open position,
- the actuator has an active state in which it exerts a force on the open valve to hold the valve in its open position, and an inactive state in which the actuator does not exert a force on the open valve,
- the actuator is able to be in its active state when it is not supplied with electric current, and in its inactive state when it is supplied with electric current,
- the actuator comprises an electromagnetic lock, in particular a permanent magnet electromagnetic lock,
- the valve comprises a metal counterplate that is movable together with the valve in order to be forced against the electromagnetic lock when the valve is open, and to be held away from the electromagnetic lock when the valve is closed, wherein the electromagnetic lock is designed to exert a biasing force of the counterplate towards its pressed position when the actuator is in its active state, wherein the biasing force is greater than the restoring force when the valve is open and is less than the restoring force when the valve is closed, the valve is mounted to move relative to the body in translation in a longitudinal direction between its open and closed positions, the control system comprises a manually-operated button, in particular a push button, to switch the valve from its blocking state to its passing state, the pumping installation comprises a containment enclosure in which the pneumatic pump is installed, while the valve is arranged outside the confinement enclosure, the pumping installation comprises a reservoir, in particular a can, containing the fluid, wherein the pneumatic pump is able to pump the fluid contained in the reservoir.

The invention also relates to an installation for spraying a coating product onto a surface to be coated, of the aforementioned type, in which the pumping installation is comprises a pumping installation as defined above.

BRIEF DESCRIPTION OF THE DRAWINGS

Other features and advantages of the invention will become apparent upon reading the description which follows, given solely by way of example and with reference to the appended drawings, wherein.

DETAILED DESCRIPTION OF THE INVENTION

Figure 1:
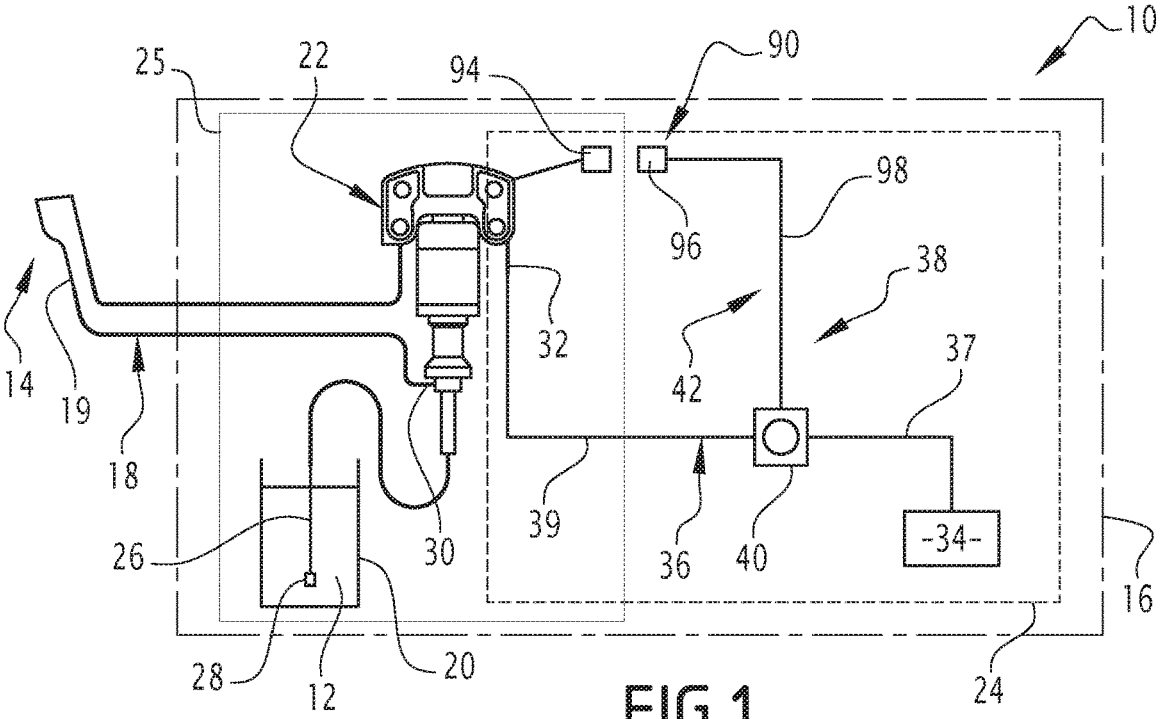
FIG. 1 shows a schematic view of a spraying installation according to the invention.

The spraying installation 10 shown in FIG. 1 is intended to spray a fluid coating product 12, typically a paint, onto a surface to be coated (not shown). For this purpose, the spraying installation 10 comprises an applicator 14 for the application of the coating product 12 on the surface to be coated, a pumping installation 16 to pump the coating product 12, and a fluidic connection 18 that fluidly connects the pumping installation 16 to the applicator 14 in order to supply the applicator 14 with the coating product pumped by the pumping installation 16.

The applicator 14 typically comprises a spray gun. It comprises a coating product supply inlet 19 that is fluidly connected to the fluidic connection 18.

The pumping installation 16 comprises a reservoir 20 containing the coating product 12, a pneumatic pump 22 for pumping the coating product 12 contained in the reservoir 20, and a system 24 for supplying the pneumatic pump 22 with compressed gas. The pumping installation 16 also comprises a containment chamber 25 in which are arranged the reservoir 20 and the pump 22.

The reservoir 20 is typically in the form of a can.

The pneumatic pump 22 comprises, in known manner, a probe 26 inserted in the reservoir 20 and defining a suction port 28 for the coating product 12, a discharge port 30 for the coating product 12 that is fluidly connected to the fluidic connection 18, a pneumatic motor (not shown) drawing its power from the expansion of a compressed gas and able to cause the movement of pumping members (not shown) and suck the coating product 12 through the suction port 28 and then push it towards the discharge port 30, and, typically, a system (not shown) for controlling the inversion of the displacement of the pneumatic motor. The pneumatic pump 22 also comprises a supply port 32 for supplying the pump 22 with compressed gas.

The system of the inversion for controlling the displacement of the pneumatic motor comprises, for example, a distributor for alternately supplying two cavities of the motor with compressed gas in order to cause a reciprocating movement of the pneumatic motor, and stroke sensors to detect when the motor reaches the end of the displacement and, in response, controls the distributor so that it changes the motor cavity supplied with compressed gas.

The supply system 24 comprises a source 34 of compressed gas, a fluidic connection 36 that fluidly connects the source 34 to the supply port 32 of the pump 22, and a system 38 for regulating the supply of compressed gas to the pump 22.

The source 34 is capable of supplying a compressed gas, for example compressed air. For this purpose, the source 34 typically comprises a compressor, in particular an air compressor.

The control system 38 comprises a valve 40 mounted on the fluidic connection 36, outside the chamber 25, wherein the valve 40 may be switched between a blocking state, in which it prevents the circulation of compressed gas between the source 34 and the pneumatic pump. 32, and a passing state, in which it allows the circulation of compressed gas between the source 34 and the pneumatic pump 32. The control system 38 also comprises a system 42 for automatically controlling the valve 40.

The fluidic connection 36 comprises an upstream section 37 between the source 34 and the valve 40, and a downstream section 39 between the valve 40 and the pump 22.

Figure 2:
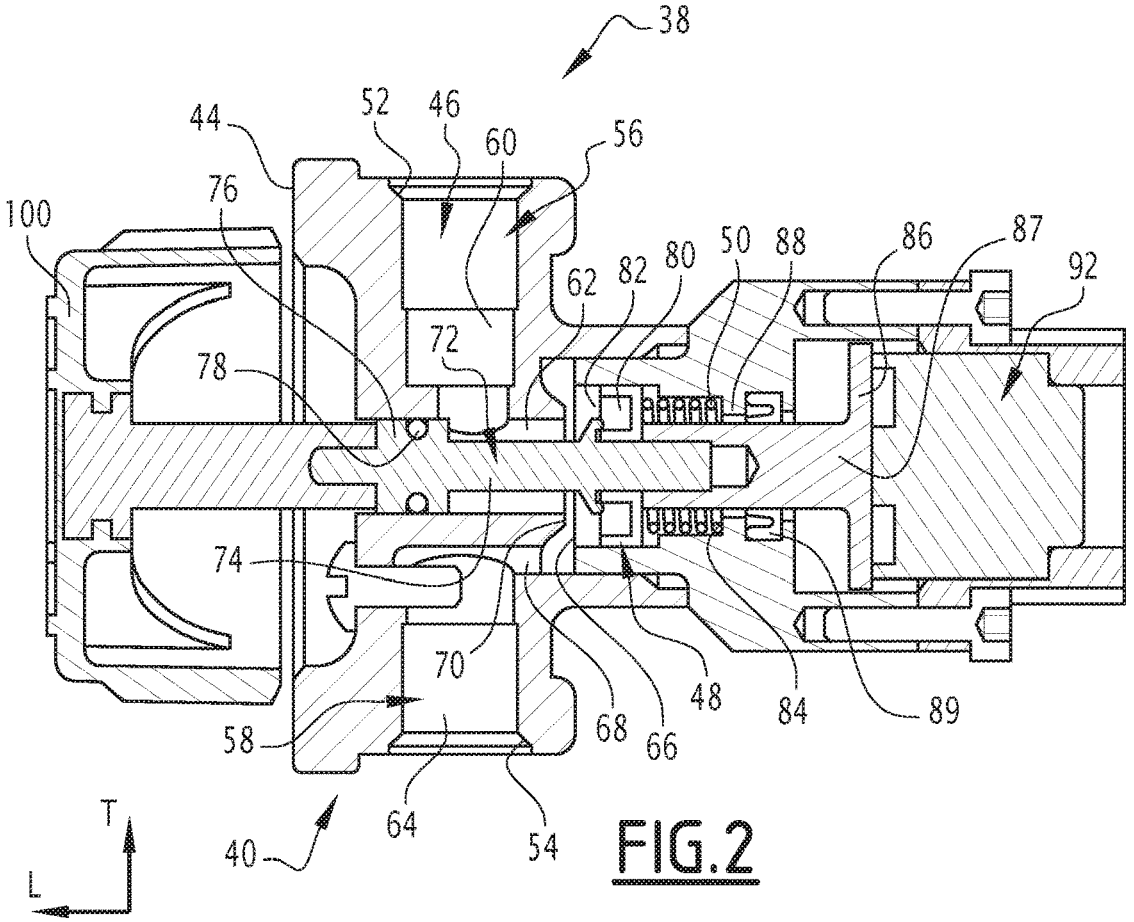
FIG. 2 shows a sectional view of a valve of the spraying installation of FIG. 1, wherein the valve is in a passing state.
Figure 3:
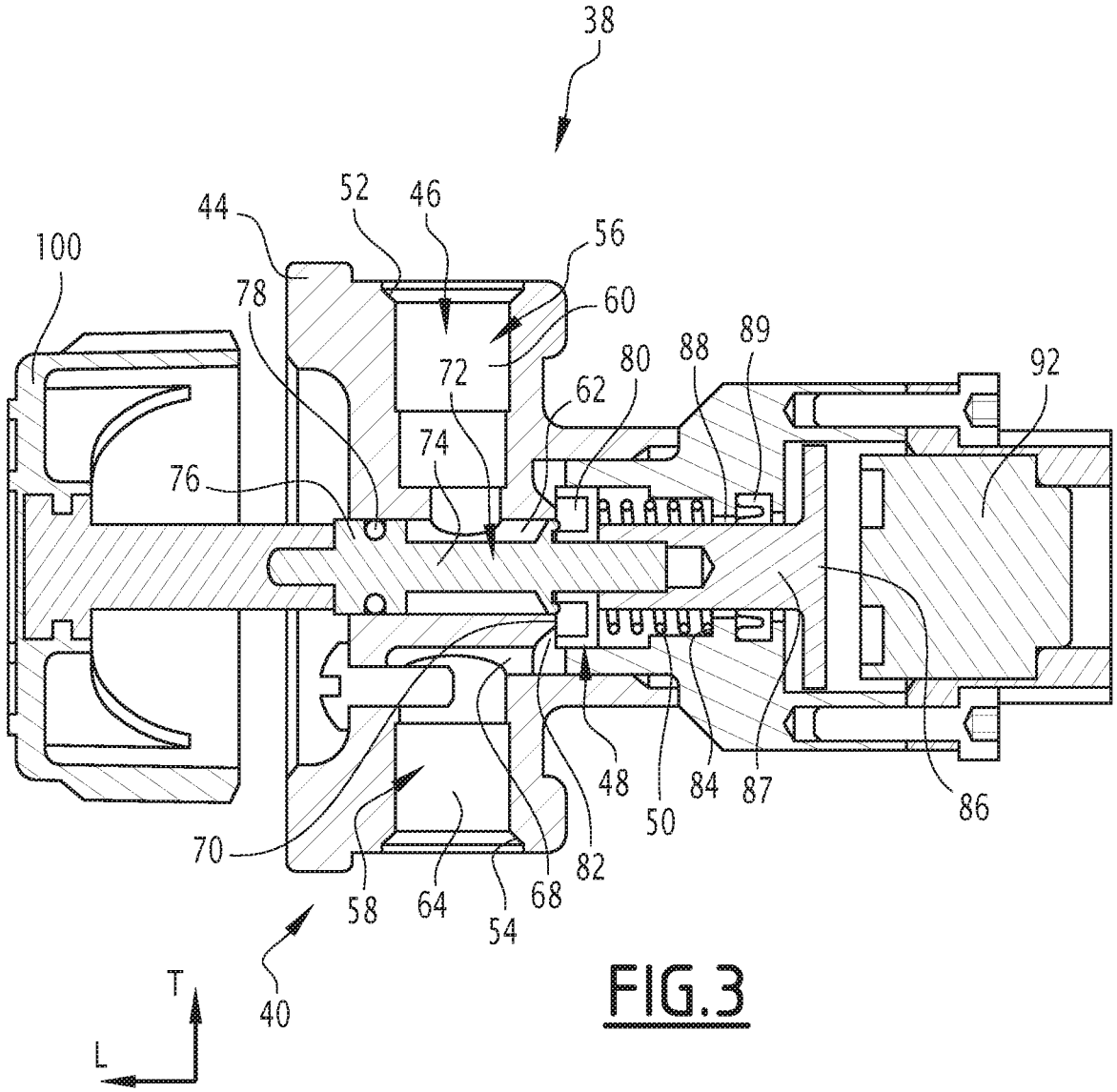
FIG. 3 shows a view similar to that of FIG. 2, wherein the valve is in a blocking state.

Referring to FIG. 2, the valve 40 comprises a body 44 internally defining a passage 46 for the compressed gas, and a valve 48 mounted to move relative to the body 44 between a closed position, in which it closes the passage 46, and an open position, in which it releases the passage 46, wherein the open position of the valve 48 corresponds to the passing state of the valve 40, while the closed position of the valve 48 corresponds to the blocking state of the passage 46. The valve 40 further comprises a member 50 for returning the valve 48 to its closed position.

The through passage 46 opens outside the body 44 via an upstream port 52 that is fluidly connected to the upstream section 37 of the fluidic connection 36, and is fluidly connected to the downstream section 39 of the fluidic connection 36 via a downstream port 54. It comprises an upstream section 56, opening outside the body 44 through the upstream port 52, and a downstream section 58, opening outside the body 44 through the downstream port 54.

In the example shown, the upstream section 56 comprises a first rectilinear channel 60, oriented in a transverse direction T, and a second rectilinear channel 62, oriented in a longitudinal direction L that is perpendicular to the transverse direction T. The downstream section 58 comprises a third rectilinear channel 64 that is oriented in the transverse direction T, wherein a cavity 66 arranged longitudinally in the extension of the second channel 62 that has a cross-section that is larger than that of the second channel 62, and a fluid connection 68 between the third channel 64 and the cavity 66. The first channel 60 opens outside the body 44 through the upstream port 52, while the third channel 64 opens outside the body 44 through the downstream port 54.

The second channel 62 opens into the cavity 66 and outside the body 44.

The body 44 also defines, at the junction between the upstream 56 and downstream 58 sections, a seat 70 for the valve 48 in the closed position. This seat 70 is, in the example shown, formed by a shoulder surrounding the port through which the second channel 62 opens into the cavity 66.

The valve 48 is mounted to move in translation along the longitudinal direction L relative to the body 44 between its open and closed positions. For this purpose, the valve 48 is, in the example shown, integral with a shaft 72 engaged in the second channel 62, wherein the shaft 72 comprises a narrow section 74, with a cross-section that is less than 90% of that of the second channel 62, and a wide section 76 with a cross-section that is substantially complementary to that of the second channel 62: wherein the shaft 72 thus forms with the second channel 62, a guide for the translational guidance of the valve 48 relative to the body 44.

The narrow section 74 is, in particular, interposed between the valve 48 and the wide section 76, wherein the wide section 76 is at a distance from the valve 48 that is greater than the distance from the valve 48 to the first channel 60 when the valve 48 is in the open position, as shown in FIG. 2. Thus, the first channel 60 is not closed by the wide section 76 when the valve 48 is open.

A seal 78 is arranged around the wide section 76, between the wide section 76 and the wall of the second channel 62. This prevents compressed gas from leaking out of the body 44 through the end through which the second channel 62 opens outside the body 44.

The valve 48 comprises an annular seal 80. This annular seal 80 defines a face 82 of the valve 48 that bears against the seat 70 when the valve 48 is closed.

In the example shown, the valve 48 is housed inside the cavity 66.

The restoring member 50 is, in the example shown, formed by a compression spring housed in the cavity 66, between the valve 48 and a bottom 84 of the cavity 66.

Still with reference to FIG. 2, the valve 40 also comprises a metal counterplate 86 arranged outside the body 44 and movable together with the valve 48 in order to take up a position close to the body 44 when the valve 48 is closed, and a position away from the body 44 when the valve 48 is open.

The counterplate 86 is aligned longitudinally with the valve 48, while the valve 48 is interposed between the seat 70 and the counterplate 86.

The counterplate 86 is, in particular, integral in translation of the valve 48. For this purpose it is, in the example shown, made of material with a shaft 87 mounted, typically screwed, on the shaft 72, and extending through an opening 88 that opens into the bottom 84 of the cavity 66 and outside the body 44. In particular, a seal 89 surrounds the shaft 87 in the opening 88 and ensures the seal between the cavity 66 and the outside of the body 44.

Returning to FIG. 1, the automatic control system 42 comprises a sensor 90 for monitoring a parameter, and an actuator 92 (FIG. 2) acting on the valve 40 to automatically switch the valve 40 from its passing state to its blocking state as a function of a signal produced by the sensor 90 and representative of the monitored parameter.

The sensor 90 comprises a first portion 94 arranged in the confinement enclosure 25, and a second portion 96 arranged outside the confinement enclosure 25.

The first portion 94 is designed to occupy a first state during normal operation, and a second state when the monitored parameter verifies a predetermined condition, wherein the second state is specific to the case in which the predetermined condition is verified.

The monitored parameter here consists of a state of the pump 22. The predetermined condition is then that the state of the pump 22 is a predetermined state, typically in the form of a runaway state of the pump 22.

Alternatively, the monitored parameter may consist of:

- a level of the coating product 12 contained in the reservoir 20, wherein the predetermined condition is that this level is lower than a predetermined value,
- a parameter that is representative of a degree of leakage of the coating product 12 at the motor of the pump 22, in particular a parameter that is representative of a degree of efficiency of the pump 22, such as, for example, a ratio between the flow of product 12 leaving the pump 22 and the product flow 12 entering, wherein the predetermined condition is that this ratio is less than a predetermined value, or
- a parameter that is representative of a level of pneumatic leakage at the motor of the pump 22, such as, for example, the flow rate of air consumed by the pump 22, wherein the predetermined condition is that this flow rate is less than a predetermined value.

The second portion 96 is able to generate an electrical signal when the first portion 94 is in its second state, and exclusively when the first portion 94 is in its second state. Thus, the second portion 96 is able to generate an electrical signal when the predetermined condition is verified, and exclusively when it is verified.

The actuator 92 is electrically connected to sensor 90 in order to receive the electrical signal when it is generated. For this purpose, an electrical connection 98 electrically connects the actuator 92 to the sensor 90.

With reference to FIG. 2, the actuator 92 consists of an electromagnetic lock, in particular a permanent magnet electromagnetic lock, aligned longitudinally with the counterplate 86, wherein the lock 86 is interposed between the valve 48 and the lock, and wherein the lock is so arranged that, when the valve 48 is in the open position, the counterplate 86 is pressed against the lock, and that when the valve 48 is in the closed position, the counterplate 86 is away from the lock.

The actuator 92 thus has, in the absence of electric current, an active state in which it exerts on the counterplate 86 a magnetic force to bias the counterplate 86 towards its position pressed against the actuator 92 and, when supplied with an electric current in an inactive state, it does not exert such a biasing force on the counterplate 86.

The restoring member 50 and the magnetizing force of the actuator 92 are so dimensioned that, when the counterplate 86 is pressed against the actuator 92, the biasing force exerted by the actuator 92 on the latter is greater than the restoring force of the restoring member 50. The actuator 92 is thus able to retain the valve 48 in its open position, wherein the biasing force forms, when the valve 48 is in the open position, a force to retain the valve 48 in the open position.

Moreover, because of the removal of this retaining force when the actuator 92 is supplied with electric current, and therefore, typically, when it receives the electrical signal generated by the second portion 96 of the sensor 90, the removal of this retaining force automatically causes the displacement of the valve 48 to its closed position under the effect of the only force continuing to be applied to the valve 48, namely the restoring force of the member 50, wherein the actuator 92 is designed to automatically switch the valve 40 from its passing state to its blocking state when it receives the electrical signal generated by the second portion 96 of the sensor 90.

The restoring member 50 and the magnetization force of the actuator 92 are also so dimensioned that, when the valve 48 is closed, the biasing force exerted by the actuator 92 on the counterplate 86 is less than the restoring force of the restoring member 50. Thus, the actuator 92 is not able to move the valve 48 from its closed position to its open position.

In order to allow the valve 48 to return to the open position, the control system 38 also comprises, as may be seen in FIG. 2, a manually-actuated button 100 for switching the valve 40 from its blocking state to its passing state. This button 100 is, in particular, formed by a push button aligned longitudinally with the valve 48, wherein the seat 70 is interposed between the valve 48 and the button 100. Thus, simple pressure on the button 100 causes the displacement of the valve 48 away from the seat 70 and, in this way, allows the valve 48 to return to its open position.

By virtue of the invention described above, it is thus possible to avoid any risk of runaway of the pump 22 as it is no longer supplied with compressed gas as soon as it begins to race. This objective is achieved first of all economically as the control system 38 has a simple design, but also reliably, since the switching of the valve 40 to its blocking state does not risk blockage.

Furthermore, the invention allows easy and economic retrofitting of the existing installation, since it all that is needed is to install the control system 38.

The invention claimed is:

1. Pumping installation comprising:

a pneumatic pump pumping a fluid;

a supply system supplying said pneumatic pump with compressed gas, comprising:

a source of compressed gas; and a fluidic connection that fluidly connects said source to said pneumatic pump; and a control system controlling the supply of compressed gas to said pneumatic pump, comprising:

a valve mounted on said fluidic connection and switchable between a blocking state, in which the valve prevents the flow of compressed gas between said source and said pneumatic pump, and a passing state, in which the valve allows the flow of compressed gas between said source and said pneumatic pump, comprising:

a body internally defining a passage for the compressed gas;

a flap mounted to move relative to said body between a closed position, in which the flap closes the passage, and an open position, in which the flap releases the passage; and a member for exerting a restoring force on said flap to close said flap when said flap is open;

a metal counterplate that is movable together with said flap;

a sensor for monitoring a parameter; and an electromagnetic lock acting on said valve to automatically switch said valve from its passing state to its blocking state as a function of a signal produced by said sensor and representative of the parameter being monitored, by exerting on said counterplate a biasing force, the biasing force being greater than the restoring force when said flap is open, thereby retaining said flap in its open position, and being less than the restoring force when said flap is closed.

2. Pumping installation according to claim 1, wherein the parameter monitored by said sensor is a state of said pneumatic pump.

3. Pumping installation according to claim 2, wherein said sensor generates a predetermined electrical signal when it detects at least one predetermined state of said pneumatic pump, and said electromagnetic lock is electrically connected to said sensor to receive this electrical signal when it is generated, said electromagnetic lock being further designed to switch said valve from its passing state to its blocking state when said electromagnetic lock receives this electrical signal.

4. Pumping installation according to claim 3, wherein the predetermined state comprises a runaway state of said pneumatic pump.

5. Pumping installation according to claim 1, wherein said electromagnetic lock has an active state in which it exerts the biasing force, which retains the flap in its open position, and an inactive state in which the open flap is not retained in its open position by said electromagnetic lock.

6. Pumping installation according to claim 5, wherein said electromagnetic lock is in its active state when not supplied with electric current, and in its inactive state when supplied with electric current.

7. Pumping installation according to claim 1, wherein said flap is mounted to move in translation relative to said body of said valve in a longitudinal direction between said flap's open and closed positions.

8. Pumping installation according to claim 1, wherein said control system further comprises a manually operated button, for switching said valve from its blocking state in its passing state.

9. Pumping installation according to claim 1, further comprising a confinement enclosure in which said pneumatic pump is installed, said valve being arranged outside the confinement enclosure.

10. Pumping installation according to claim 1, further comprising a reservoir, containing the fluid, said pneumatic pump being able to pump the fluid contained in the reservoir.

11. Installation for spraying a coating product onto a surface to be coated, comprising:

an applicator for spraying the coating product onto the surface to be coated; and a pumping installation according to claim 1 for pumping the coating product and supplying said applicator with the coating product.

* * * * *